United States Patent [19]

Wynn et al.

[11] Patent Number: 5,067,341

[45] Date of Patent: Nov. 26, 1991

[54] TRANSFER PLATE LIFTS FOR SHELL PRESS

[75] Inventors: David K. Wynn, Tipp City; Omar L. Brown, Dayton, both of Ohio

[73] Assignee: Dayton Reliable Tool & Mfg. Co., Dayton, Ohio

[21] Appl. No.: 467,811

[22] Filed: Jan. 19, 1990

[51] Int. Cl.[5] ..... B21D 43/00

[52] U.S. Cl. ..... 72/426; 72/344; 72/349; 72/361

[58] Field of Search ..... 72/344–347, 72/349, 420, 421, 426, 427, 428, 361; 413/8, 56; 100/207

[56] References Cited

U.S. PATENT DOCUMENTS

| | | | |
|---|---|---|---|
| 1,935,854 | 11/1933 | McCreary | 72/349 |
| 4,026,226 | 5/1977 | Hahn et al. | 413/8 |
| 4,282,736 | 8/1981 | Mashburn | 72/345 |
| 4,343,173 | 8/1982 | Bulso, Jr. et al. | 72/345 |
| 4,364,255 | 12/1982 | Byrd | 72/345 |
| 4,599,884 | 7/1986 | Bachmann et al. | 72/346 |
| 4,770,022 | 9/1988 | Cook et al. | 72/405 |
| 4,904,140 | 2/1990 | Herdzina | 413/56 |

*Primary Examiner*—Frederick R. Schmidt
*Assistant Examiner*—Jack Lavinder
*Attorney, Agent, or Firm*—Joseph G. Nauman

[57] ABSTRACT

A method and apparatus are disclosed for making and transferring shells for cans within a ram press. The shells are formed in a two-step operation in which shell preforms are formed at a first station within the press and then transferred to second station where they are formed into completed shells. The first station includes first and second rows of tooling sets with the tooling sets of the first row being located in alternating transverse positions relative to the tooling sets of the second row. Similarly, the second station includes third and fourth rows of tooling sets in which the tooling set of the third row are located in alternating transverse positions relative to the tooling sets of the fourth row, and the tooling sets of the third and fourth rows are located for receiving the shell preforms from the tooling sets of the second and first rows, respectively. The shell preforms formed in the first row are transferred along a lower transfer plate within the press to the fourth row tooling, and the shell preforms formed in the second row are transferred along an upper transfer plate within the press to the third row tooling. In addition, extendable cylinders are provided for lifting the lower and upper transfer plates to provide access to the lower tooling and shell transfer paths.

29 Claims, 9 Drawing Sheets

TRANSFER PLATE LIFTS FOR SHELL PRESS

BACKGROUND OF THE INVENTION

The present invention relates to a method and apparatus for the formation of shells to close the ends of metal cans and, more particularly, to a method and apparatus for forming shells for can ends at two stations contained within the same press and for transferring the shells between the stations.

One common way of packaging liquids such as soft drinks, beer, juices and the like, is within cans typically formed from aluminum. In such cans, a unitary or deep drawn can body is usually manufactured to include the can side walls, as well as an integral bottom. Other cans may have a coated metal seamed body, with a separate attached bottom which might be in the form of a shell such as is used for forming a can top, as is described further below. In either event, the upper end, which includes the means by which the can is later opened, is manufactured separately and attached to the can body after the can has been filled. These so-called easy-open or "pop-top" ends are made from a shell which is converted to an end by appropriate scoring and attachment of a pull tab by integral riveting techniques. The shells are manufactured from sheet metal by severing a suitable blank from a strip of stock material, forming the blank to define a central panel, surrounded by a reinforcing countersink and chuckwall configuration and a shell curl which is designed to interact with a body curl of a can during sealing of the can. The blank may be of the type disclosed and claimed in commonly assigned U.S. Pat. No. 4,637,961.

The shells may be formed in a two-stage operation in which a shell preform is formed at a first station and the preform is transferred to a second station where it is subsequently reformed into a completed shell. In known methods of shell production, a blank is removed from a strip of stock material wherein the shell preform is formed in a first stroke of the press ram and the shell preform is reformed into a completed shell at the second station in a subsequent stroke of the press ram.

A transfer system is provided for transferring the shells from the first to the second station during opening of the tooling in the press. In one approach, the shell preform formed within the first tooling station is vertically positioned for transfer and a device is actuated to strike the shell with an edgewise blow that propels it outwardly from the tooling. Alternatively, a shell which is positioned for transfer may be struck from the side by a stream of pressurized gas issuing from an orifice positioned adjacent to the shell.

Examples of these types of transfer systems may be seen in U.S. Pat. Nos. 4,561,280 and 4,770,022. In these patents, when the actuator or gas stream strikes the shell, the shell is caused to move along the transfer path. Ideally, the shell moves in free flight without contacting any portions of a restraining structure defining the path until the shell is captured at the second station. In addition, a cushion of air may be provided along the lower portion of the shell path in order to minimize contact between the shell and the surface in the tooling defining the transfer path.

Various tool lay-out modifications for the first and second tooling stations are disclosed in U.S. Pat. No. 4,567,746 and which may incorporate the transfer systems described above. This patent shows tooling lay-outs which may operate on stock material moving either from the front to the rear of the press or from side to side through the press. For example, the lay-out shown in FIG. 12 of this patent shows the material being fed from the front to the rear of the press with the first stations located over the stock material at the center of the press and the second stations located to either side of the stock material such that the transfer mechanism transfers the preformed shells sideways to the second stations.

In the lay-out shown in FIG. 13 of the '746 patent, the stock material is transferred from side to side through the press and the first stations are located over the stock material near a front portion of the press and the second stations are located adjacent to the stock material near a rear portion of the press. The tooling lay-outs for the above presses are arranged such that after passing through the first stations the scrap stock material remaining from the formation of the shell preforms is passed out of the press into a suitable chopper. It should be noted that the tooling is arranged such that after passing the first stage tooling, the web of scrap material will pass out of the press without intersecting the second tooling such that the web does not interfere with the transfer of the shell preforms or the operation of the tooling at the second station. As a result of this constraint on the tooling arrangement, the width of stock material available for a given press bed size is limited by the need to provide sufficient room for the second tooling and for removal of the scrap web, and thus the entire working area of the press bed is not utilized to its fullest potential.

In order to increase the output rate of the above-described press lay-outs, either the operating speed of the press must be increased such that more shells may be produced per unit of time from a given size of stock material, or the bed size of the press must be increased to accommodate a larger width of stock material and additional tooling stations, with consequent larger tooling.

It can be seen, therefore, that a tooling lay-out for a two-stage press is needed wherein the area of the press bed is fully utilized such that the number of shells produced per press stroke is maximized. Further, a tooling lay-out is needed for maximizing the output of the press while efficiently removing scrap metal, so as not to interfere with the transfer of shell preforms or the operation of the second shell forming stations.

SUMMARY OF THE INVENTION

The present invention provides a method and apparatus for the formation of shells to close the ends of metal cans. A sheet of thin metal is incrementally fed to a first station, at which a generally circular blank is separated from the sheet and partially formed into the shell. The partially formed shell is then transferred from the first station along a predetermined path by means of a stream of pressurized gas which strikes the partially formed shell from the side and causes it to be propelled toward a second station where the formation of the shell is completed.

Shell formation, as outlined above, is performed within a conventional ram press, with the first and second stations each including tooling operated by the press ram. Operations at the first and second stations occur simultaneously, so as a shell is completed within the second station, the immediately succeeding shell is being initially formed within the first station. The transfer between successive stations is accomplished sufficiently quickly for a shell initially formed within the first station by a first stroke of the press ram to be positioned for final formation within the second station by the next succeeding stroke.

The first station includes parallel first and second rows of tooling sets in which the tooling sets of the first row and second row are offset relative to one another in a direction transverse to the direction in which the sheet material is fed into the press such that the centers of the first and second row tooling sets are positioned in a staggered or zig-zag pattern across the width of the press. Each of the first and second rows of tooling sets includes upper first and second rows of tooling connected to the ram and cooperating lower first and second rows of tooling, respectively, supported on the base of the press.

Similarly, the second station includes third and fourth rows of tooling sets arranged in a staggered or zig-zag pattern similar to that of first and second rows of tooling. Each of the third and fourth rows of tooling sets includes upper third and fourth rows of tooling connected to the ram and cooperating lower third and fourth toolings, respectively, supported on the base of the press. The third row tooling sets are positioned to receive partially completed shells from the second row tooling sets and the fourth tooling sets are positioned to receive partially completed shells from the first row tooling sets.

The press further includes lower and upper transfer plates provided with means forming transfer paths wherein the transfer from the first to fourth row sets of tooling occurs along the transfer paths on the lower transfer plate and the transfer from the second to the third sets of tooling occurs along the upper transfer plate. A stream of pressurized gas for propelling the shells from the tooling sets is supplied by a nozzle located adjacent to each of the tooling sets. An air manifold is associated with each of the rows of tooling sets for providing the pressurized gas to the nozzles.

In addition, the upper tooling for each of the tooling sets is provided with means for producing a partial vacuum along a bottom surface thereof for holding the shell on the upper tooling as the upper tooling separates from the lower tooling. When the upper tooling for the first and second rows has moved the partially completed shells into position adjacent to the nozzles, the manifold associated with that particular row of tooling is supplied with pressurized gas to overcome the retaining force of the vacuum holding the shells on the upper tooling and to simultaneously propel all the shells on that particular row along the transfer paths. In a similar manner, the nozzles for the third and fourth rows are actuated to propel the completed shells from the press.

The sheet of thin material used for forming the shells is incrementally conveyed into the press along an upper portion of a stock support plate at the front of the press and beneath a front portion of the lower transfer plate. The tooling sets of the first and second rows are spaced from adjacent ones of tooling sets in the same row by a distance slightly less than the diameter of the blank removed from the sheet material, and as mentioned above, the centers of the tooling sets of the first row of tooling are located in transversely alternating positions with respect to the tooling sets of the second row of tooling such that a maximum number of shell blanks may be removed from the sheet material with a minimum of waste. After the sheet material has been punched by the second row of tooling sets, the remaining web or scrap skeleton continues to pass under the front portion of the lower stripper plate until it reaches a rearward end of the stock support plate where it is conveyed downwardly out of the press between the second and third rows of tooling sets.

By locating the transfer paths of the first and second rows of tooling sets on different vertical levels, it is possible to slightly overlap the location of the tooling sets for the first and second rows in a direction transverse to the direction of conveyance of the sheet material, while maintaining a sufficient center-to-center transverse spacing between the tooling sets of each of the rows to permit partially completed shells from the first row to pass between adjacent stations in the second row, such that a punch pattern is formed on the sheet material which maximizes the use of the material. Further, by conveying the sheet material on a level beneath the lower transfer level, it is possible to remove the scrap material from the press without interfering with the transfer of the partially completed shells from the first to the second stations.

The present invention also provides means for selectively providing access to the lower transfer plate, the stock support plate and the lower tooling. Means are provided for selectively raising the ram above its uppermost operational position to thus provide space for the upper and lower transfer plates and the stock support plate to be lifted away from the base of the press. A plurality of first extendable cylinders are carried on the base and pass outside the lower transfer plate to be connected to the upper transfer plate for selectively lifting the upper plate from the lower plate. In addition, a plurality of second extendable cylinders are carried on the base and connected to the lower support plate such that extension of the first and second cylinders together cause the lower and upper plates to be lifted together away from the base.

DETAILED DESCRIPTION OF THE PREFERRED EMBODIMENT

Figure 1:
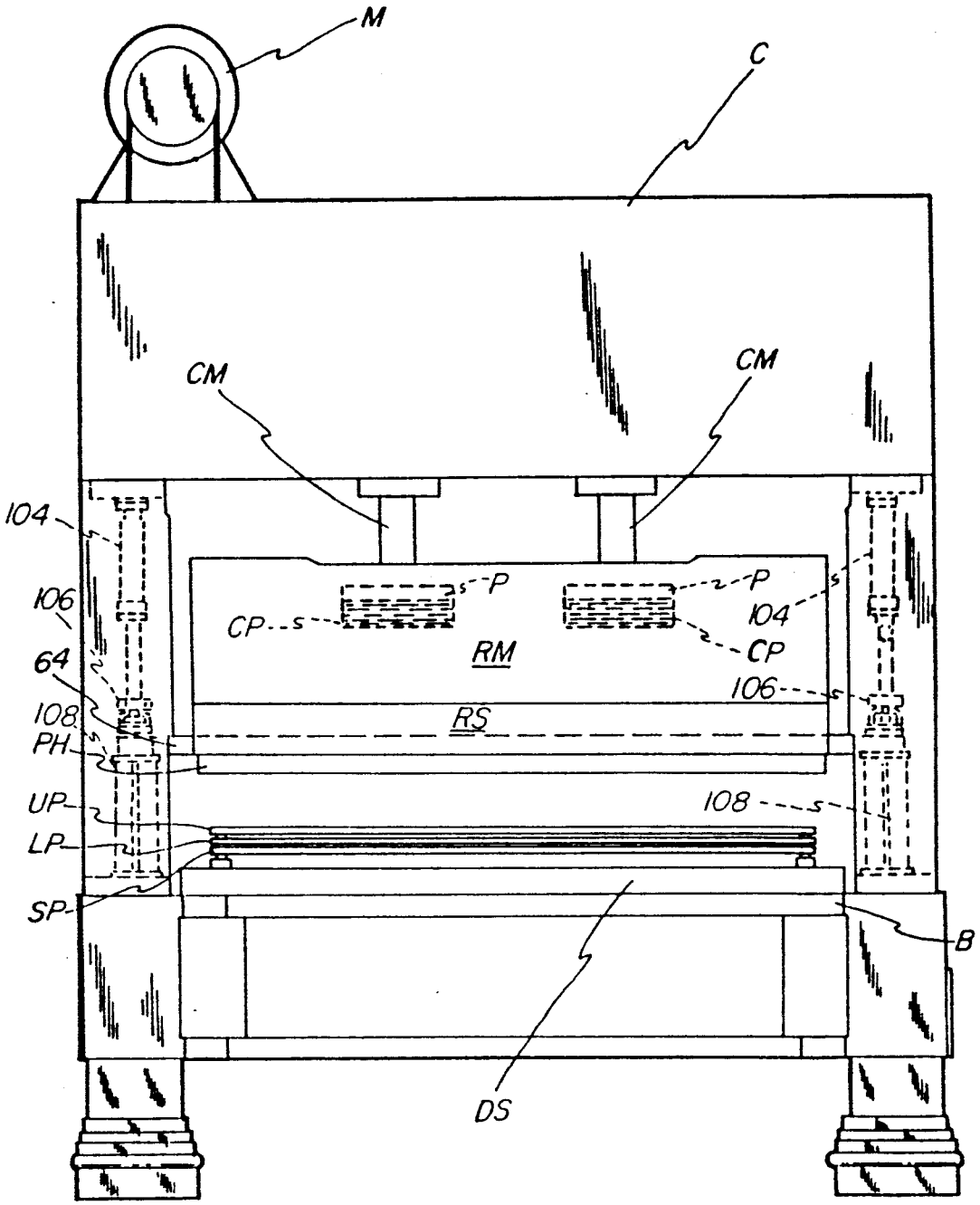
FIGS. 1 and 2 are, respectively, front and side views of a typical ram press as utilized in the present invention.
Figure 2:
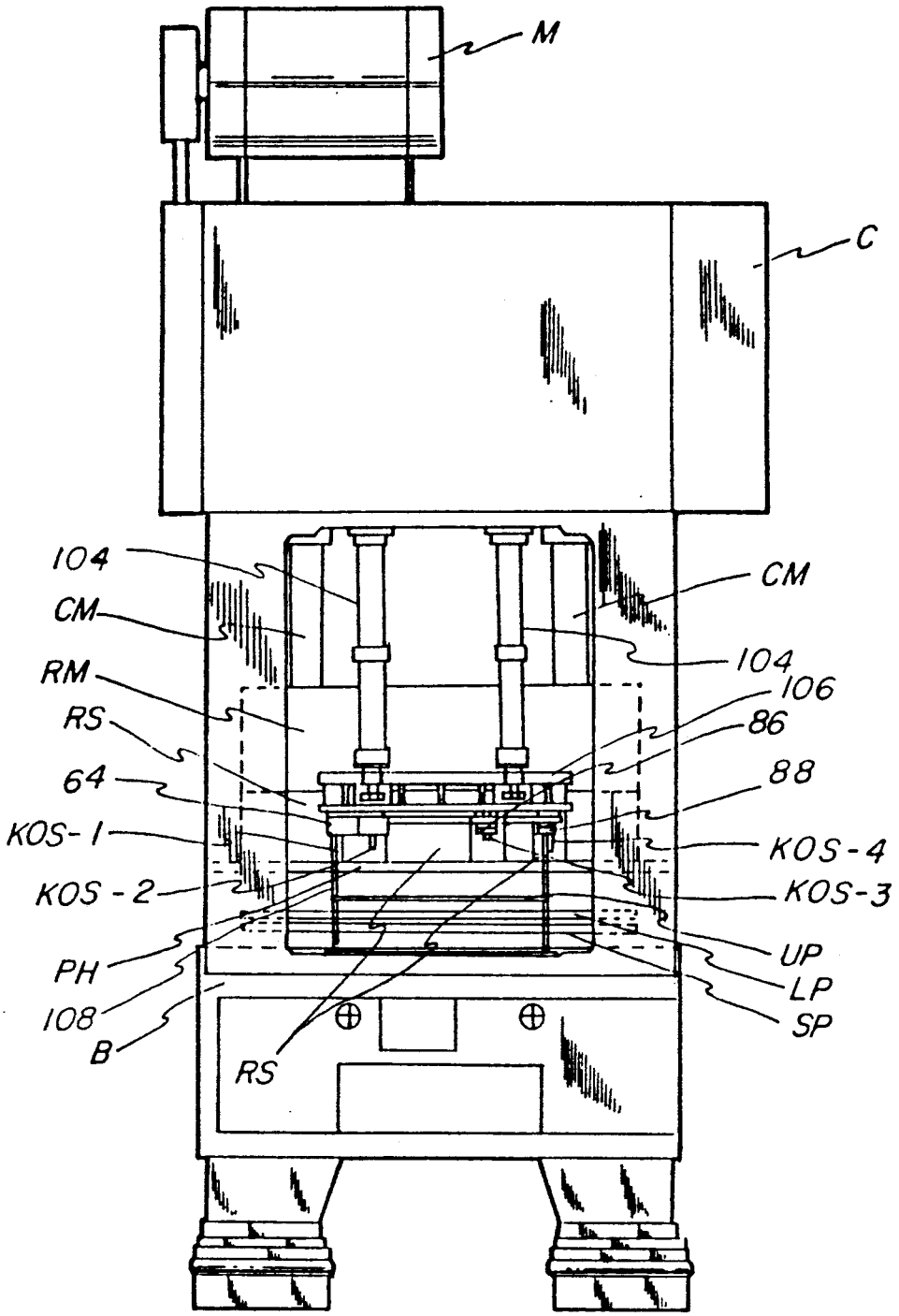

Referring now to the drawings, a typical ram press used in the manufacturing of shells for can ends might be a Minster SAS4-H125-90 press, the outline and layout of which is shown in FIGS. 1 and 2. The press includes a drive motor M mounted on the top of the crown C of the press for driving a ram RM in reciprocating motion between an upstroke and a downstroke position through a set of four cylinder members CM extending down from the crown C. The ram is guided in its reciprocating motion by the side guides (not shown) which are part of the press structure, and additional guiding is provided by conventional ball bearing and bushing guides (not shown) at each of the four corners of the ram. A punch holder PH is supported from the lower surface of the ram for supporting the upper portion of a tooling set provided for the formation of shells. The punch holder is spaced from the lower surface of the ram by a set of spaced risers RS which extend across the width of the ram.

The press further includes a bed B which supports a die shoe DS for mounting the lower tooling of the tooling set for forming the shells. The die shoe DS supports an upper transfer plate UP, a lower transfer plate LP and a stock support plate SP which are provided for purposes to be described below.

The present invention is not dependent upon any specific method of shell formation, so long as the shells are at least partially formed with the ram press at a first location within the press and subsequently formed into a completed shell for use in forming can ends at a second location within the press. In the preferred embodiment, a thin sheet of metal stock material SM is fed incrementally into the press at a stock feed level between the stock support plate SP and the lower transfer plate LP until the stock material SM is aligned with a set of first stations where a substantially circular blank is punched out of the sheet material SM and formed into a shell preform by cooperating upper and lower die sets. The shell preform is then transferred to a point where it is aligned with a second station, where a second set of cooperating upper and lower tooling form the shell preform into a completed shell, and the completed shell is then transferred from the press. In addition, after the stock material SM leaves the first station tooling, the remaining scrap material is transferred out of the press at a point intermediate the first and second tooling stations.

Figure 3:
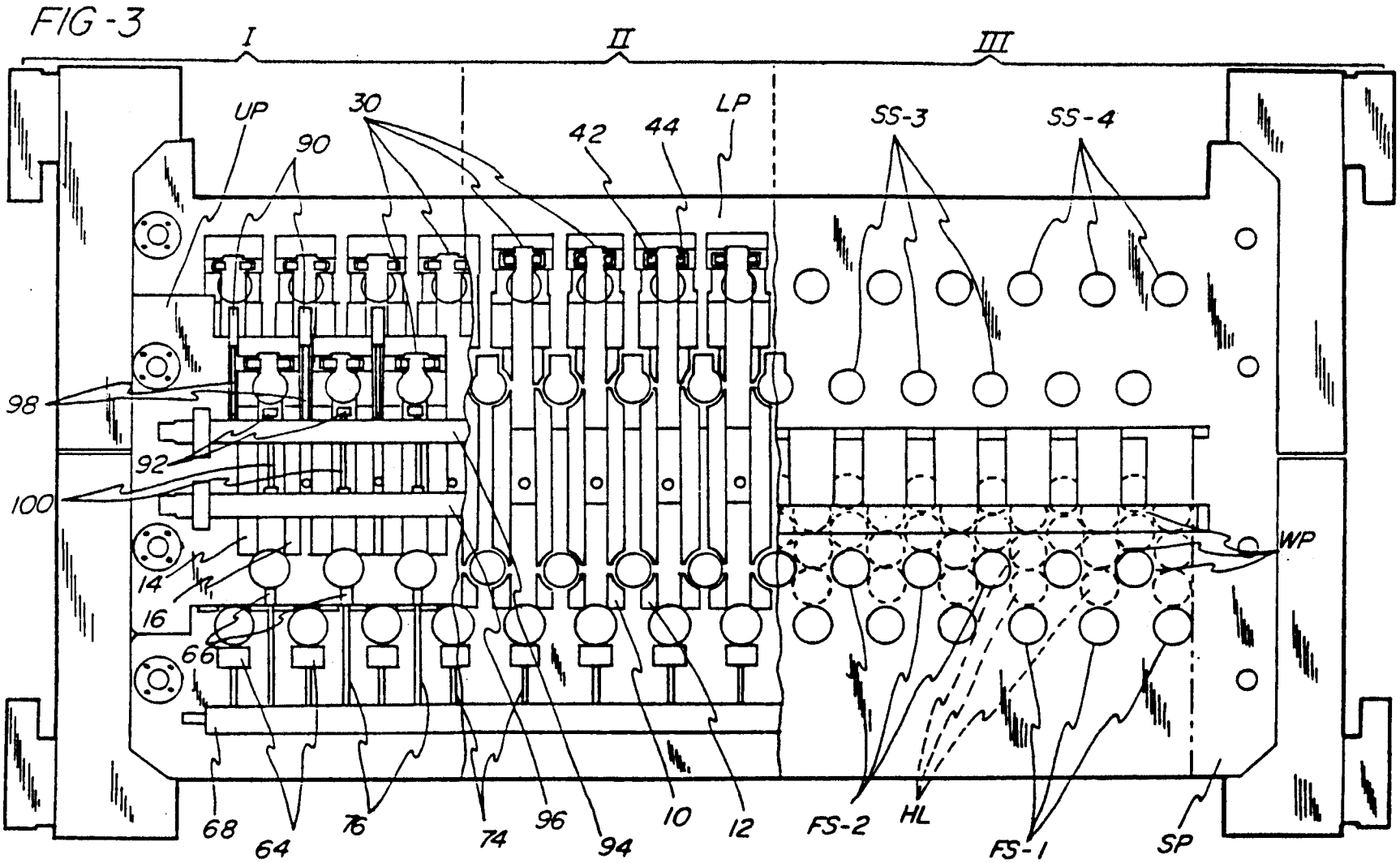
FIG. 3 is a plan view of the transfer apparatus of the present invention in which area I shows the transfer apparatus with both the upper and lower transfer plates in place, area II shows the transfer apparatus with the upper transfer plate removed and with the positions of the lower level guide rails shown, and area III shows the transfer apparatus with both the upper and lower transfer plates removed and with the path of the scrap skeleton shown.

As may be seen in FIG. 3, the tooling for the present invention may be arranged in four parallel rows including first and second rows FS-1 and FS-2, respectively, at the first station, and third and fourth rows SS-3 and SS-4, respectively, at the second station. The tooling of the second row FS-2 is offset relative to the tooling of the first row FS-1 in a direction transverse to the direction in which the stock material SM is fed into the press such that the centers of the tooling of the first and second rows are positioned in a staggered or zig-zag pattern across the press. Further, the tooling of the first and second rows are spaced from immediately adjacent tooling in the same row by a distance slightly less than the diameter of the blank removed from the stock material.

Area III of FIG. 3 shows the pattern formed on the stock material by the two rows of first station tooling and in which it may be seen that the holes HL left in the stock material SM are joined by thin web portions WP such that the amount of material in the scrap skeleton resulting from the blanking operation is minimized. The tooling of the third and fourth rows SS-3 and SS-4 is arranged in alternating transverse locations similar to the lay-out of the first and second rows such that tooling of the first row FS-1 is aligned with the tooling of the fourth row SS-4 in a longitudinal direction with respect to the direction of conveyance of the stock material SM, and the tooling of the second row FS-2 is similarly aligned with the tooling of the third row SS-3.

Figure 4:
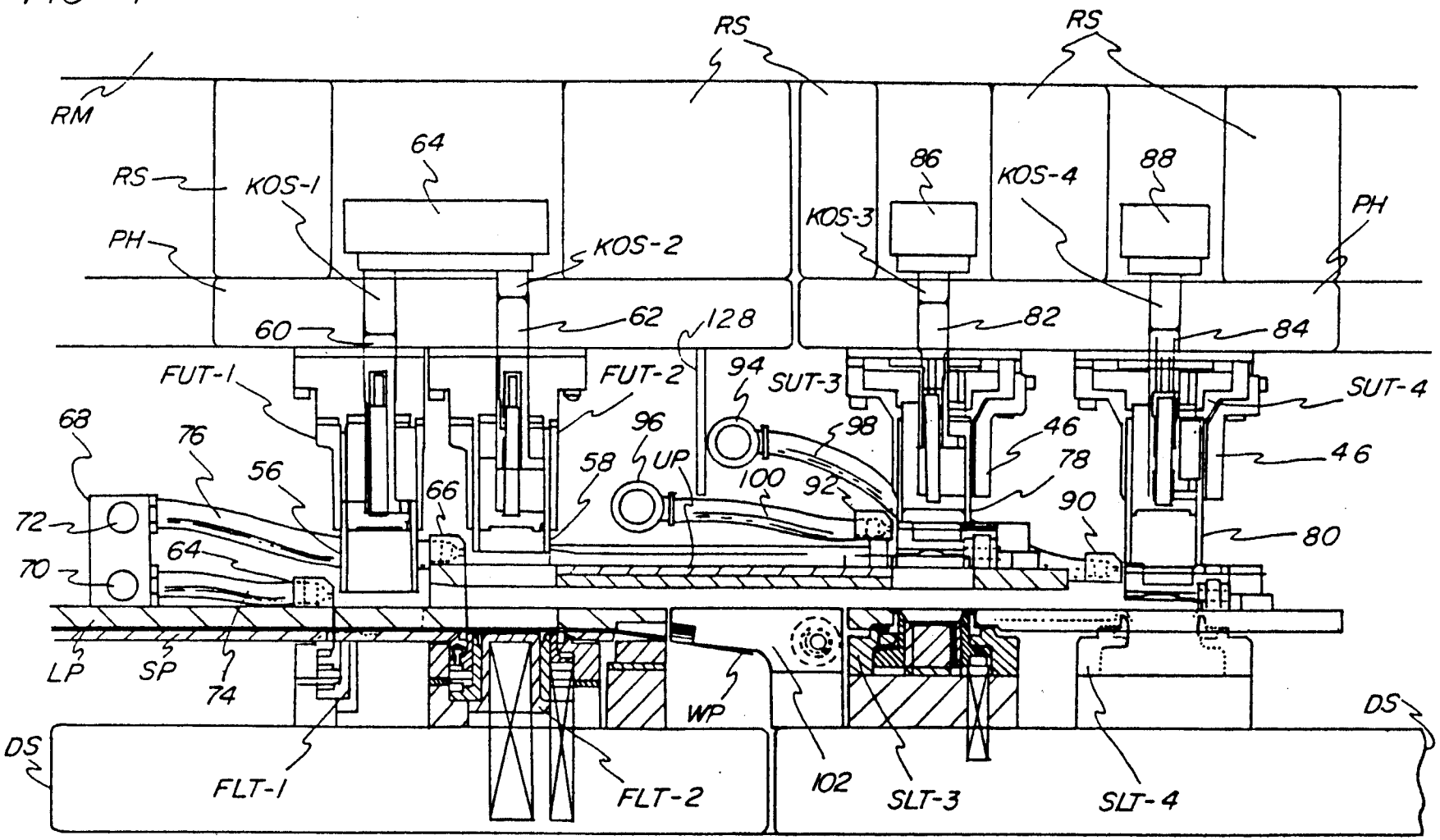
FIG. 4 is an elevational view of the present invention with the ram of the press in an uppermost operational position.

The first station, first row upper and lower tooling FUT-1 and FLT-1, respectively, and second row upper and lower tooling FUT-2 and FLT-2, respectively, which are shown generally in FIG. 4, may be substantially similar in structure and operation to the first station tooling described in commonly assigned Bachman et al, U.S. Pat. No. 4,561,280 issued Dec. 31, 1985, which is hereby incorporated by reference. The first station tooling of U.S. Pat. No. 4,561,280, as generally shown in FIGS. 1–5 of that reference, forms a generally circular blank from the sheet of stock material and partially forms the blank into a shell preform comprising a substantially flat central panel and an upwardly extending chuckwall about the edge of the panel. In addition, the tooling includes means for forming a partial vacuum along a bottom surface of the tooling such that the partially completed shell or preform will be held against a knock-out and positioner element just prior to propelling the partially completed shell from the first station to the second station.

The second station, third row upper and lower tooling SUT-3 and SLT-3, respectively, and fourth row upper and lower tooling SUT-4 and SLT-4, which are shown generally in FIG. 4, and are substantially similar to the second station tooling shown in FIGS. 6–10 of U.S. Pat. No. 4,561,280 and which forms a countersink at the base of the chuckwall of the partially completed shell by moving the substantially flat central panel upwardly relatively to the chuckwall to produce a completed shell. The second station tooling also includes means for forming a partial vacuum along a bottom surface of the upper portion of the tooling to facilitate lifting and holding the completed shell away from the bottom tooling for transferring the shell out at the press. In addition, the tooling of the second station is positioned along a transfer path for receiving and catching the partially completed shells from the first station tooling during opening of the tooling subsequent to the downstroke forming the partially completed shell or preforms such that the formation of the shells may be completed at the second station during the subsequent downstroke of the press ram.

It should be noted that the upper working surface of each of the first through the fourth row lower tooling FLT-1, FLT-2, SLT-3, SLT-4 is located at substantially the same level as the stock feed level.

Referring to sections I and II in FIG. 3, the transfer paths between the tooling sets of the first and second stations are each formed as substantially horizontal paths defined by a pair of guide rails 10, 12 which guide the partially completed shells from the first row FS-1 of the first station to the fourth row SS-4 of the second station along the lower transfer plate LP, and pairs of guide rails 14, 16 guide the partially completed shells from each of the tooling sets of the second row FS-2 of the first station to the tooling sets of the third row SS-3 of the second station along the upper transfer plate UP. The transfer paths formed by guide rails 10 and 12 are located substantially between the upper and lower plates and partially overlap the movement space of second and third row upper tooling FUT-2, SUT-3 which is defined by the area swept out by the lower portion of each of the upper tool members in their vertical movement toward and away from the lower tooling. Thus, the shell preforms from the first row FS-1 are transferred through a part of the movement space and under at least a portion of the tooling second and third rows FS-2, SS-3 such that the transfer of the shell preforms along the lower plate LP must be performed at a time when the upper tooling for the second and third rows FS-2, SS-3 has cleared the lower transfer path.

Figure 6:
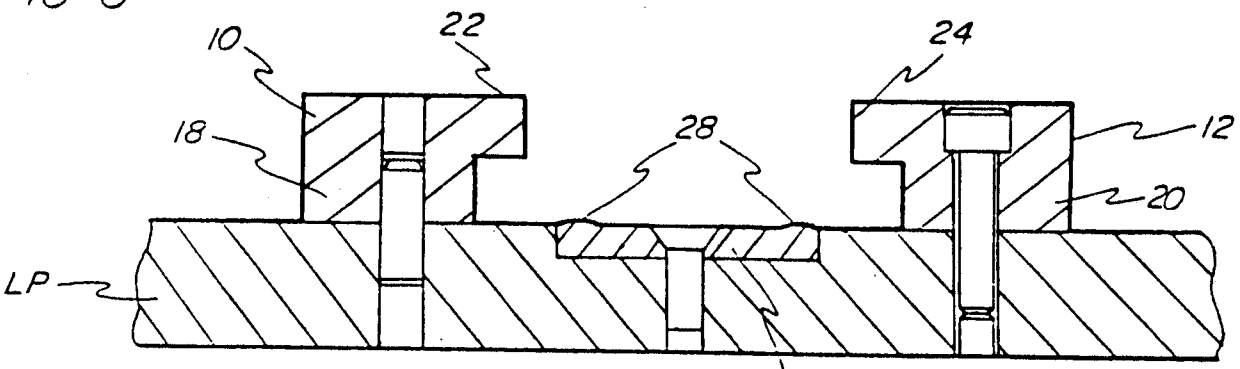
FIG. 6 is a sectional view taken generally along line 6—6 of FIG. 5.
Figure 5:
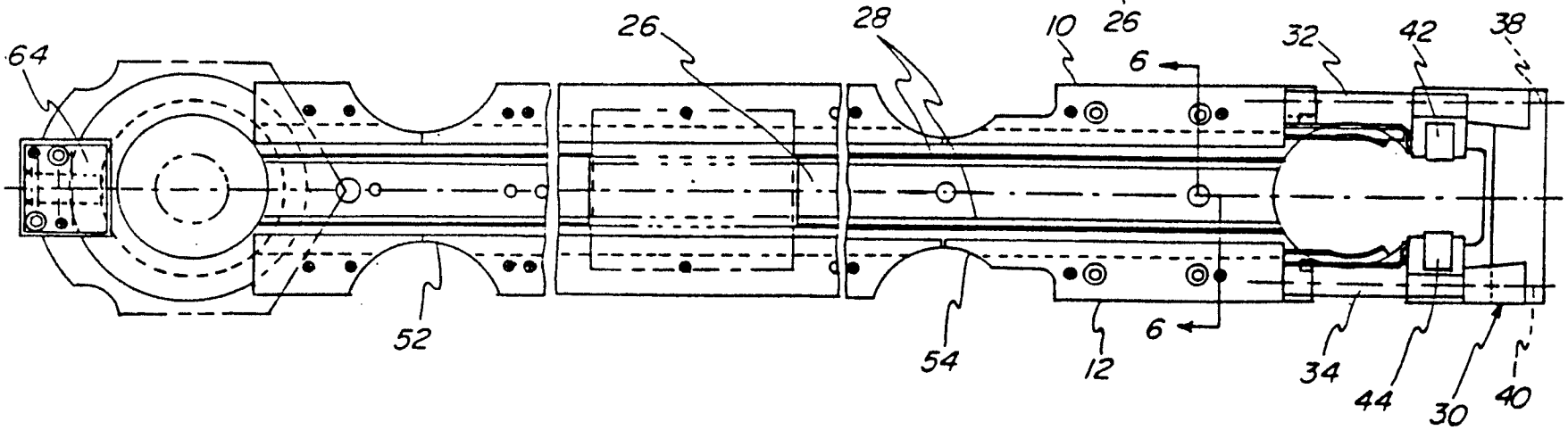
FIG. 5 is a plan view of one of the transfer paths along the lower transfer plate.

Details of the lower transfer path are shown in FIGS. 5 and 6 in which can be seen that the guides 10 and 12 are formed with vertically extending walls 18, 20, respectively, and horizontally extending flanges 22, 24 protruding over the guide path. Although the guide rails 10, 12 are shown attached to the lower plate, they may alternatively be attached to the bottom surface of the upper plate as is described further below.

The guide path further includes a low friction plate 26 forming the bottom surface of the guide path. The low friction plate 26 includes a pair of longitudinally extending raised beads 28 which form contact points with the partially formed shells as they travel in free flight from the first to the second stations. Ideally the partially completed shells will have a minimum amount of contact with the boundary surfaces formed by the guides 10 and 12 and the plate 26 such that the shell preforms will not be slowed by frictional forces in their flight from the first to the second stations.

As may be further seen in FIG. 5, the end of each guide path is provided with a catch mechanism 30 for capturing and locating the shell preforms at the second station. The catch mechanism 30 is substantially similar to that shown in Bachman et al U.S. Pat. No. 4,561,280. The catch mechanism 30 includes a pair of side members 32, 34 which are mounted to a base member 36 for pivotal movement about horizontal axes 38, 40, respectively, longitudinally aligned with the direction of the guide path. The side members 32, 34 are each provided with a camming wheel 42, 44 which is positioned for engagement with a cam 46 (see FIG. 4) mounted to the upper portions SUT-3, SUT-4 of the second station tooling sets.

The catch mechanism 30 of the present invention differs from the mechanism shown in U.S. Pat. No. 4,561,280 in that an arcuate finger is located within and extends along an interior portion of each of the side portions 32, 34. The arcuate fingers 48, 50 are spring mounted for movement in a direction transverse to the transfer direction of the partially completed shell preforms. Thus, as the shell preforms enter the catch mechanism 30, the fingers 48, 50 move outwardly to allow the shell preforms to enter the mechanism and then partially surround the shell to hold it in place. As the upper portions SUT-3, SUT-4 of the second tooling sets move downwardly, the cam 46 engages the rollers 42, 44 to pivot the side portions 32, 34 outwardly and thus allow the upper portions SUT-3, SUT-4 of the second tooling sets to engage the partially completed shells without contacting the catch mechanism 30.

In order to accommodate the overlap between the transfer path on the first level or lower plate LP and the upper tooling FUT-2, SUT-3 of the second and third rows, the guide rails 10, 12 include cut-out portions 52, 54 which correspond in shape to the outline of the upper tooling. Since the partially completed shell preforms travel along the transfer paths with a minimum amount of contact with the walls of the guides 10, 12, the interruption in the guide path which occurs at the intersection of the guide rails 10, 12 with the tooling location of the second and third rows FS-2, SS-3 will not significantly affect the guiding of the shell preforms as they travel from the first row FS-1 to the fourth row SS-4. Further, it should be apparent that the transfer paths formed by the guide rails 14, 16 on the second level or upper plate UP may be formed with substantially the same structure as that used for the lower transfer paths defined by the guide rails 10, 12 and the low friction plate 26.

Referring now to FIG. 4, it can be seen that the upper tooling FUT-1, FUT-2 of the first and second rows each include knock-out and positioner elements 56 and 58, respectively, having upper portions 60, 62 extending into apertures in the punch holder PH and which function in the same manner as the knock-out and positioner elements described in U.S. Pat. No. 4,561,280.

First and second row knock-out stems KOS-1, KOS-2, respectively, are mounted to a stationary bar 64 extending transversely across the press in the space defined between the bottom surface of the ram RM, the risers RS and the upper surface of the punch holder PH. The bars 64 are positioned and the vertical dimension of the risers is selected such that the ram and punch holder may move between their upper and lowermost positions without contacting the bar 64.

The stems KOS-1, KOS-2, extend from the bottom of the bar 64 and are positioned such that they will enter the apertures containing the portions 60, 62 during an upstroke of the ram and punch holder. As the stems KOS-1, KOS-2 enter the punch holder, they will contact the upper portions 60, 62 of the knock-out and positioner elements 56, 58 and thereby limit the upward movement of elements 56, 58 as the upper tooling FUT-1, FUT-2 is carried upwardly, such that the lower surfaces of the elements 56, 58 carrying the shell preforms from the level of the stock material will be located slightly above first and second transfer levels, respectively.

Each tooling set of the first and second rows FS-1, FS-2 is provided with a nozzle 64, 66, each being mounted on the lower plate LP and having an orifice located at the lower and upper transfer levels for supplying a sudden burst of pressurized gas to thereby apply an edgewise force to the shell preforms held by the knock-out and positioner elements 56, 58 such that the vacuum force holding the preforms to these elements is overcome and the preforms are propelled edgewise toward the second station. The nozzles 64, 66 may operate in substantially the same manner as the gas nozzles of the transfer system disclosed in commonly assigned Cook et al U.S. Pat. No. 4,770,022, issued on Sept. 13, 1988, and which is incorporated herein by reference.

The nozzles 64, 66 of the present invention are supplied with pressurized gas from a manifold structure 68 which is mounted to and extends transversely across the upper surface of the lower transfer plate LP. The passages 70, 72 are connected to their respective nozzles by means of flexible tubes 74, 76 and at least one valve controls the flow of pressurized gas into each of the passages 70, 72 for energizing the nozzles 64, 66.

It should be noted that the air flow to the lower nozzles 64 is controlled such that it will be effective to propel the preforms to the second station only after the first station tooling has opened sufficiently to locate the upper tooling FUT-1, FUT-2 above the first or lower level transfer path. Similarly, the air flow to the upper nozzles 66 is controlled such that it will be effective to propel the preforms to the second station only after the second row upper tooling FUT-2 is located above the second or upper level transfer path.

The upper tooling SUT-3 and SUT-4 of the third and fourth rows each include form punch and positioner elements 78 and 80, respectively, having upper portions 82, 84 extending into apertures in the punch holder PH and which function in the same manner as the form punch and positioner elements described in U.S. Pat. No. 4,561,280.

Third and fourth row knock-out stems KOS-3, KOS-4 are mounted to stationary bars 86 and 88, respectively, which extend through spaces defined between the bottom surface of the ram RM, the risers RS and the upper surface of the punch holder PH in a manner similar to the bar 64. The function of the stems KOS-3, KOS-4 and the upper portions 82, 84 in positioning the lower surfaces of the form punch and positioner elements 78, 80 is identical to the operation of the stems KOS-1, KOS-2 and upper portions 60, 62 in positioning the lower surfaces of the first station knock-out and positioner elements 56, 58.

Each tooling set of the third and fourth rows SS-3, SS-4 is provided with a nozzle 90, 92, each being mounted on the upper plate UP and having an orifice located above the lower and upper transfer levels, respectively. The nozzles 90, 92 operate in the same manner as the nozzles 64, 66 of the first station and apply an edgewise force in the form of a burst of pressurized gas to forcibly overcome the vacuum force holding the completed shells to the lower surface of the form punch and positioner elements 78, 80 and propel the shells out of the press in the same direction as the shells are conveyed from the first to the second stations.

The nozzles 90, 92 of the second station, in the embodiment shown, are supplied with pressurized gas from a pair of manifold tubes 94, 96 which are mounted to the upper plate UP and which are connected to the nozzles by means of flexible tubes 98, 100. The manifold tubes 94, 96 are each connected to a source of pressurized gas via a control valve in a manner similar to that described for the manifold passages 70, 72 of the first station such that the fourth row nozzles 90 will be effective to propel the completed shells from the press only after the upper tooling SUT-3, SUT-4 has separated from the lower tooling SL-3, SL-4 and risen above the first or lower level transfer path and the third row nozzles 92 will only be effective to propel the completed shells from the press only after the third row upper tooling SUT-3 has risen above the level of the second or upper transfer path.

It should be noted that although the completed shells of the third row SS-3 must pass between the form punch and positioner elements 80 of adjacent fourth row upper tooling, the shells will not contact the form punch and positioner elements 80 in their passage out of the press since the completed shells are of a significantly smaller diameter than the blank from which they were formed and thus of a small enough diameter to pass freely between the fourth row tooling elements.

In addition, it should be apparent that as the fourth row upper tooling SUT-4 moves to a position above the lower transfer path, the cam members 46 thereon disengage from the camming wheels 42, 44 of the lower level catch mechanism 30 such that these mechanisms are now operational to capture and locate partially formed shells arriving from the first station. Similarly, as the third row upper tooling SUT-3 moves upwardly above the second or upper transfer level, the cam members 46 thereon is disengaged from the cam wheels 42, 44 on the upper level catch mechanisms 30, such that these mechanisms are now operational to capture and locate partially formed shells arriving from the second row FS-2 of the first station.

The stock material SM for forming the shells is conveyed incrementally through the press between the stock support plate SP and the lower transfer plate LP and thus is positioned in a location where it will not interfere with the transfer of the shells from the first to the second station. Further, the web or scrap skeleton WP remaining after the stock material passes through the first station is directed downwardly out of the press at a location between the second and third rows FS-2, SS-3. As the scrap skeleton WP passes from between the lower plate LP and stock support plate SP, it may be cut or chopped transversely of the direction in which the material is conveyed such that smaller pieces are formed. A chopper mechanism 102 appropriate for this purpose is shown pivotally mounted for chopping the material as it passes away from the stock support plate, and which chopper mechanism is described more fully in copending application Ser. No. 07/467,472, filed concurrently herewith, now U.S. Pat. No. 5,044,189 and assigned to the same assignee.

In operation, a sheet of stock material SM is fed into the front of the press at a stock feed level above the stock support plate SP and below the lower transfer plate LP by a set of feed rollers (not shown) such that the stock material SM enters the press in incremental movements synchronized with the movement of the press ram RM. Feed mechanisms for incrementally feeding stock material into a press are per se old and well known in the art and may feed the stock material from a roll of material or, alternatively, a sheet feeder may be provided for supplying individual sheets of stock material.

When the stock material SM overlays the first and second rows of FS-1 and FS-2 of the first station, the ram RM is caused to move downwardly thus moving the upper tooling toward the press bed. As the first station upper tooling FUT-1, FUT-2 contacts the sheet material SM, it cuts out a substantially circular blank from the sheet material SM and continues downwardly to form the blank into a partially formed shell preform.

After a plurality of partially formed shell preforms are simultaneously formed in the first and second rows FS-1, FS-2 of the first station, the ram moves upwardly and thereby causes the upper tooling to separate from the lower tooling and the partially formed shell preforms which are held on a bottom portion of the upper tooling by the partial vacuum which is formed within the knock-out and positioner elements 56, 58. As the upper and lower tooling separate, the preforms are moved from the stock feed level to the first or lower transfer level at which time the upper portion 60 of the knock-out and positioner element 56 of the first row tooling contacts the knock-out stem KOS-1 such that the bottom surface of the knock-out and positioner element 56 positions the shell preforms in alignment with the nozzle 64. The upper tooling continues to separate from the lower tooling until the second row FUT-2 of the first station tooling has cleared the lower level transfer path defined by guide rails 10, 12. When the lower level transfer path is cleared, a stream of pressurized gas supplied by the manifold passage 70 issues from the nozzle 64 with a force sufficient to propel the shell preforms along the lower transfer path where they are captured and located by a lower level catch mechanism 30. Subsequently, the upper portion 62 of the knock-out and positioner element 58 contacts the knock-out stem KOS-2 such that the knock-out and positioner element 58 is held immediately above the second or upper transfer level and the shell preform attached thereto is positioned adjacent to the nozzle 66 at which time a stream of pressurized gas supplied by the manifold passage 72 issues from the nozzle 66 with a force sufficient to propel the shell preforms toward the third row SS-3 of the second station tooling where they are capture and located by upper level catch mechanisms 30.

The catch mechanisms 30 positioned at the third and fourth rows SS-3, SS-4 of the second station hold the shell preforms in position between the upper and lower tooling of the second station tooling sets. In the next downward movement of the press ram RM subsequent to the formation of the blanks and shell preforms the upper tooling moves toward the lower tooling whereby the cam portions 46 engage the cam rollers 42, 44 to pivot the sides 32, 34 of the catch mechanisms 30 outwardly such that the shell preforms are released and may be carried downwardly with the upper tooling SUT-3, SUT-4. The tooling SUT-3, SUT-4 then continues to move toward the lower tooling and complete the formation of the shells at the bottom of the stroke of the ram RM. The ram RM then carries the upper tooling upwardly to a point where the upper portion 84 of the form punch and positioner 80 contacts the knock-out stem KOS-4 such that the completed shell is held in alignment with the nozzle 90 for ejection from the press at a level slightly above the lower transfer level. The manifold 94 is energized to provide pressurized gas to the nozzle 90 to thereby eject the completed shell.

Subsequently, the upper portion 82 of form punch and positioner 78 contacts the knock-out stem KOS-3 such that the completed shell attached to the bottom of the form punch and positioner 78 is held adjacent to the orifice means 92. The manifold 96 is energized to eject the completed shell by means of a pressurized gas stream at a level slightly higher than the upper transfer level for the shell preforms.

It should be noted that while the shells are being completed at the third and fourth rows SS-3 and SS-4 of the second station, additional shell preforms are being formed at the first and second rows FS-1 and FS-2 of the first station in preparation for transfer to the second station where they will be formed into completed shells in the next subsequent stroke of the press ram RM. Thus, each station performs a shell forming operation with each stroke of the press ram RM.

It should be apparent that the path traversed by the shell preforms traveling from the first row FS-1 of the first station to the fourth row SS-4 of the second station is greater than the distance traversed by the shell preforms from the second row FS-2 of the first station to the third row SS-3 of the second station and thus the transfer time for shells on the upper transfer level will be less than the transfer time for those on the lower transfer level. It should also be apparent that the transfer of the shell preforms from row FS-1 of the first station to the second station is initiated prior to the time at which the second row shell preforms reach the upper transfer level. Thus, although the upper level transfer is initiated later than the first level transfer, the shells on the upper level traverse a shorter distance and therefore will still reach the second station prior to the time at which the upper tooling SUT-3 of second station reaches the upper transfer level in its downward movement for carrying the third row shell preforms toward the lower tooling to form them into a completed shells.

The tooling and transfer lay-out described above provides a means for efficiently using the area of the press bed to produce a large number of shells as well as a means to efficiently use the stock material from which the shells are produced. A press using the above method and apparatus may be set up to use common widths of stock material and it is contemplated that tooling may be typically provided for producing 22, 24 or 27 shell ends per press stroke. Thus at typical nominal press speeds of approximately 235 strokes per minute, as many as 6,345 shells or more may be produced per minute by the present tooling and transfer lay-out.

The preferred embodiment of the present invention also includes means for selectively moving the ram RM above its upstroke position to thereby provide access to the transfer plates UP, LP and support plate SP mounted to the base of the press. In addition, the transfer plates UP and LP are each provided with a set of extendable cylinders such that the plates of the press may also be selectively lifted to thereby expose and provide access to different levels of the tooling mounted to the base of the press.

Figure 7:
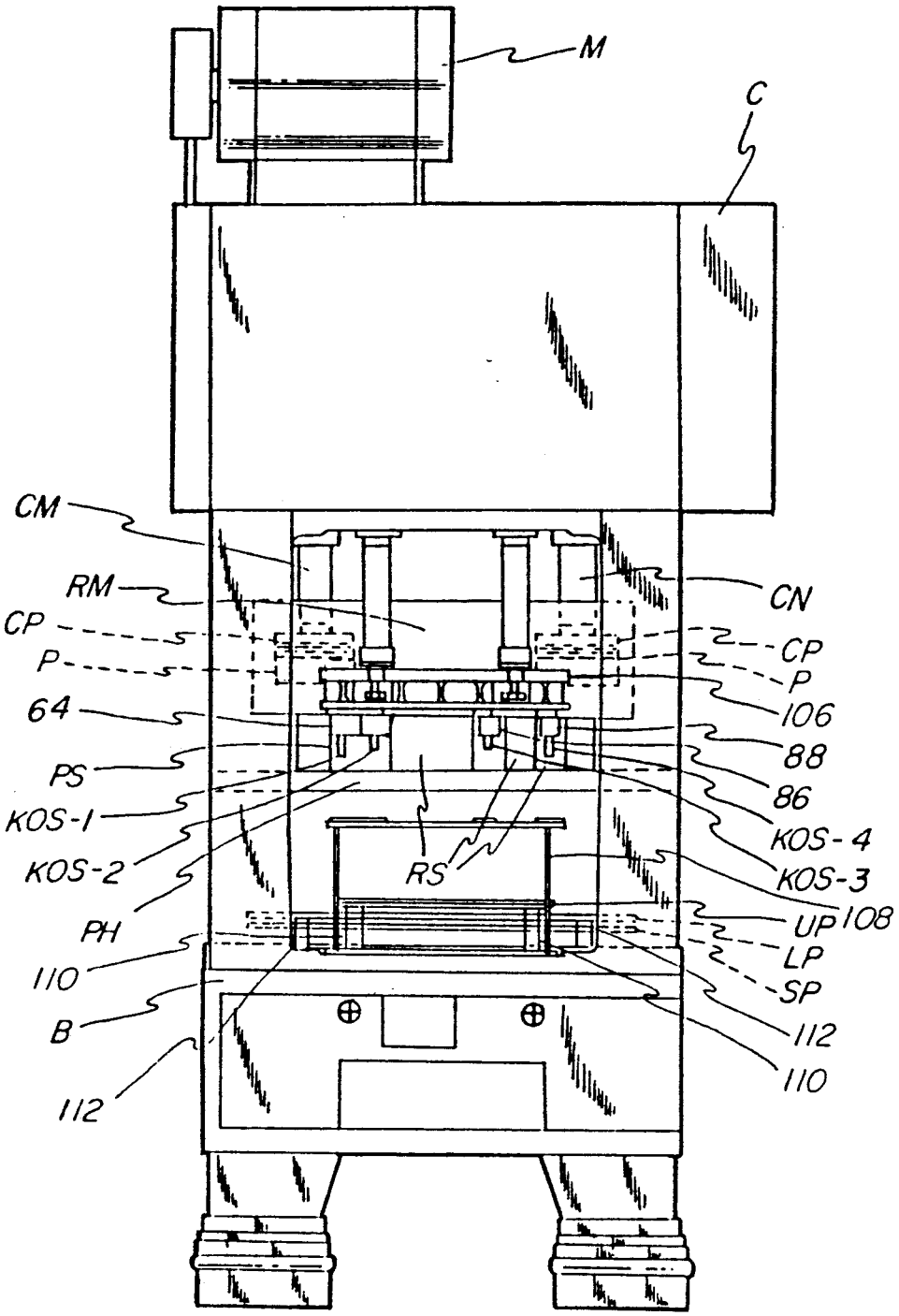
FIG. 7 is a side view similar to FIG. 2 in which the ram and knock-out bars have been moved to their uppermost positions to provide access to the transfer pates.

As may be best seen in FIGS. 1, 2 and 7, the ram RM of the press includes cylinder portions CP formed therein for engaging pistons P which are attached to the bottom ends of the cylinder members CM extending from the press crown C. In the operational position of the ram, as seen in FIGS. 1 and 2, the piston P is located in the top of the cylinder portion CP and the lower portion of the cylinder portion CP is filled with a pressurized fluid which is maintained at a pressure sufficient to prevent movement of the piston P within the cylinder portion CP during operation of the press ram RM. Thus, the weight of the ram and the pressurized fluid within the lower part of the cylinder portion CP act to maintain the ram in a lowered position with respect to the cylinder members CM during the reciprocating motion of the ram as it is driven by the cylinder members CM.

When it is desired to selectively raise the ram above its upstroke position, the pressurized fluid in the cylinder portions CP may be transferred to the upper part of the cylinder portion such that the piston P and the lower portion of the cylinder member CM move toward the lower part of the cylinder portion CP resulting in upward movement of the ram RM, as seen in FIG. 7. In the preferred embodiment of the invention the ram can be moved upwardly at least $6\frac{3}{4}$ inches (17.15 cm) from its upstroke position.

In order to accommodate the upward movement of the ram, the kick-out bars 64, 86, 88 are mounted on extendable kick-out bar cylinders 104 which are attached to a fixed point relative to the crown C of the press at one end thereof. The other end of the cylinders 104 are attached to connecting beams 106 which mount the kick-out bars 64, 86, 88 for movement with the cylinders 104. Support members 108 are mounted on each side of the press base and support the beams 106 when the cylinders 104 are extended to position the kick-out bars 64, 86, 88 in their lowermost position to thereby locate the kick-out stems in their operational positions.

When it is desired to raise the ram RM above its upstroke position, the cylinders 104 are first actuated such that the kick-out bars 64, 86, 88 move upwardly away from the punch holder PH until they engage the bottom surface of the ram RM. Subsequently, the fluid in the cylinder portions CP of the ram RM is transferred from the bottom to the top of the pistons P such that the ram RM is forced upwardly, and the kick-out bars 64, 86, 88 continue their upward movement while maintaining contact with the lower surface of the ram RM until the ram and kick-out bars assume an uppermost position, as depicted in FIG. 7.

In order to provide further access to the transfer plates and tooling mounted on the base of the press, a first set of extendable cylinders 110 are carried on the base of the press and pass through the lower transfer plate LP to connect to the upper transfer plate UP such that extension of the first set of cylinders 110 causes the upper plate UP to be lifted away from the lower transfer plate LP. Further, a second set of extendable cylinders 112 are mounted on the base of the press and are connected to the lower transfer plate LP such that extension of the first and second set of cylinders 110, 112 together causes the lower and upper plates LP, UP to be lifted together away from the base of the press to thereby expose the stock support plate SP.

Figure 8:
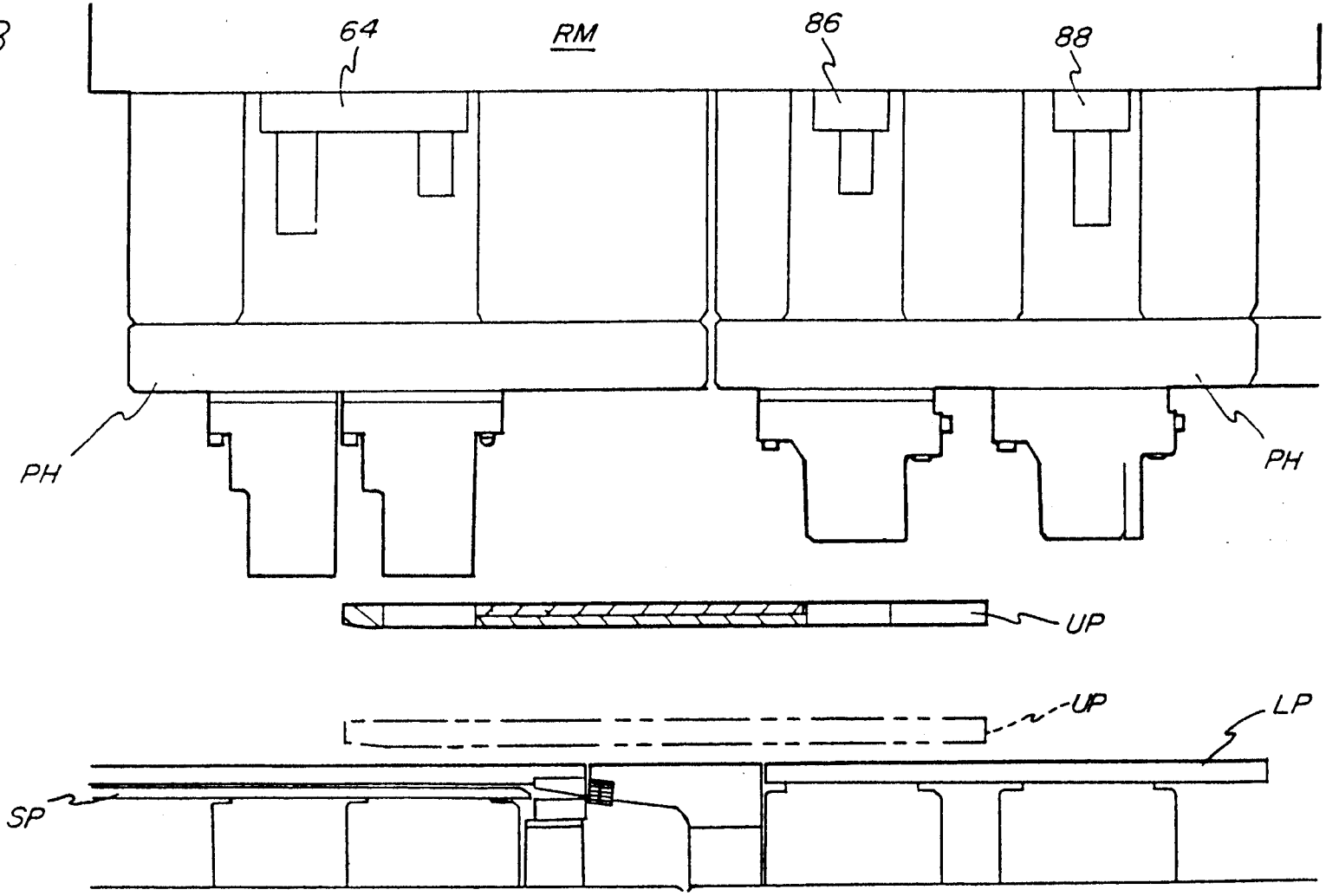
FIG. 8 is a diagrammatic elevational view in which the upper transfer plate is shown in its uppermost position away from the base of the press.
Figure 9:
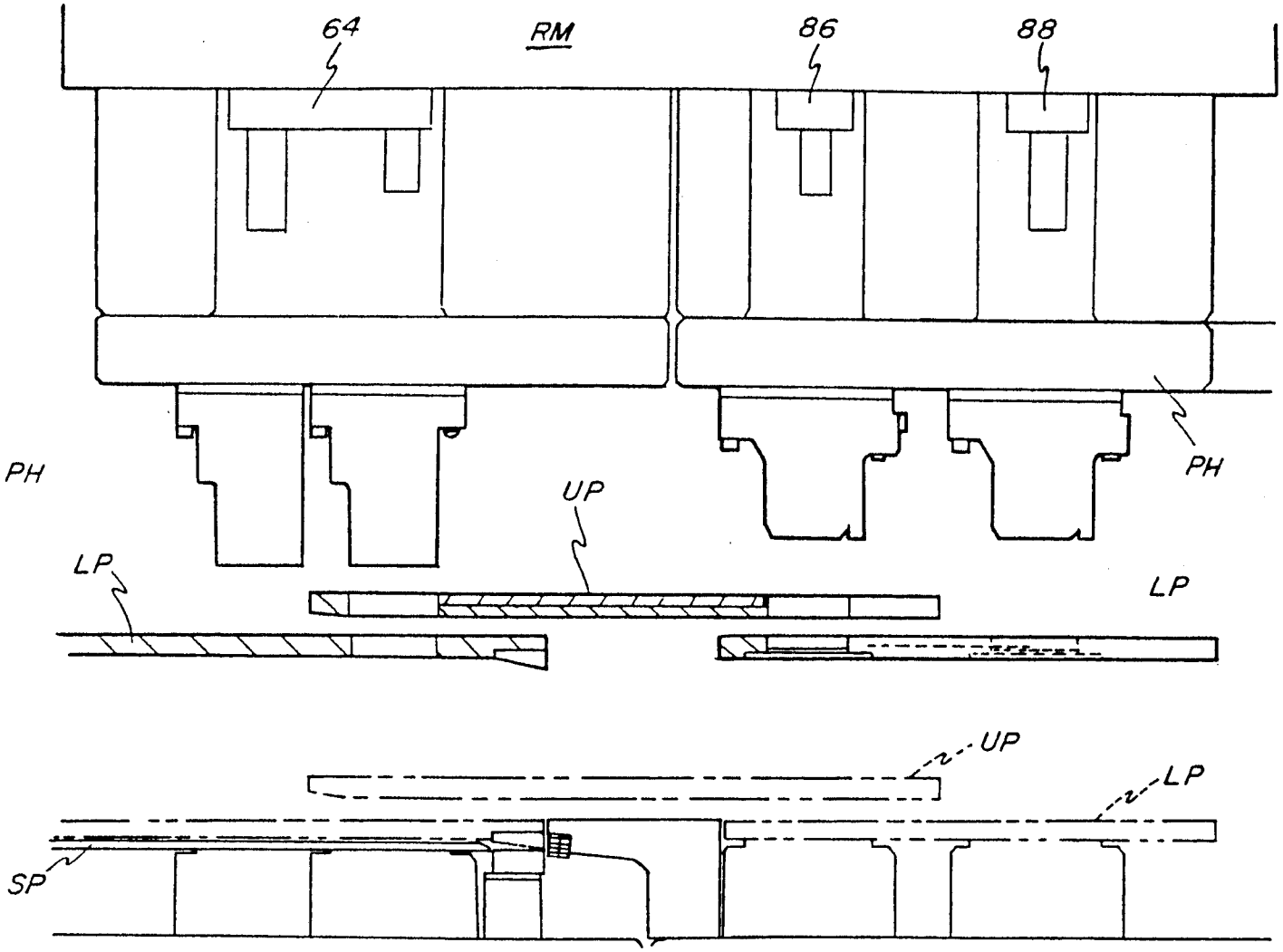
FIG. 9 is a diagrammatic elevational view in which both the upper and lower transfer plates have been lifted to their uppermost position above the base of the press.
Figure 10:
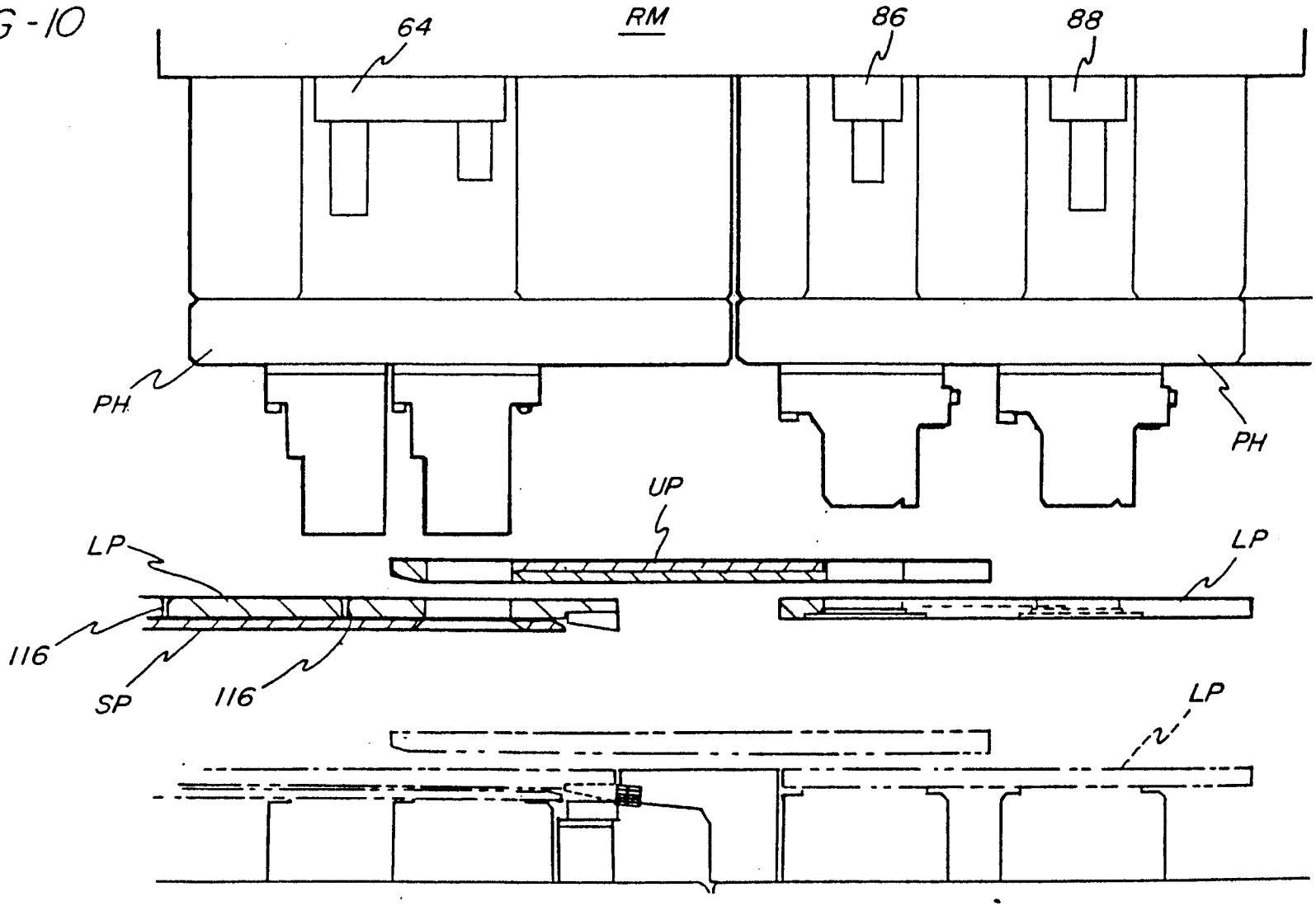
FIG. 10 is a diagrammatic elevational view in which the upper and lower transfer plates and the stock support plate have been lifted to their uppermost position above the base of the press.

FIGS. 8–10 show the various combinations in which the plates may be lifted above the base of the press and in which the operational position of the lifted plates is shown with phantom lines. FIG. 8 shows the first mode of lifting in which only the first set of extendable cylinders 110 are actuated to cause the upper transfer plate UP to rise above the lower transfer plate LP to thereby expose and provide access to the lower transfer path. It should be noted that the lower guide rails 10, 12 positioned between the upper and lower transfer plates WP. LP may be attached to the upper transfer plate UP so as the upper transfer plate is lifted, the lower guide rails 10, 12 are also lifted away from the lower plate LP.

FIG. 9 shows a second mode of operation in which both the first and the second sets of extendable cylinders 110, 112 are actuated such that the upper and lower transfer plates UP, LP are lifted simultaneously above the base of the press. In this mode of lifting exposes and provides access to the stock support plate SP and the feed level of the web material.

FIG. 10 shows a final mode of lifting in which the stock support plate SP is attached to a front portion of the lower transfer plate LP by means of appropriate fasteners such as bolts which are depicted generally at 116. This mode of lifting is similar to that of FIG. 9 in that both the first and second sets of extendable cylinders 110, 112 are simultaneously actuated to thereby lift the upper and lower transfer plates and the stock support plate together and thereby expose the lower tooling members mounted on the base of the press.

From the above description, it should be apparent that the present invention provides ready access to both the upper and lower transfer levels of the press as well as to the stock feed and lower tooling elements. Thus, in the event of a blockage of one of the transfer paths or any other problem occurring within the tooling, the press ram may be readily displaced away from the base of the press and the transfer plate and stock support plate may be selectively lifted to provide ready access to the problem area.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Apparatus for forming a plurality of shells such as used in the manufacture of can ends, comprising:

a base;

a ram;

means for supporting said ram at a distance above said base;

means for reciprocating said ram toward and away from said base between an upstroke and a downstroke position, respectively;

a stock support plate supported by said base for receiving and supporting a sheet of stock material;

means for guiding the sheet of stock material at a feed level along said stock support plate;

first and second tooling sets, each of said first and second tooling sets being configured for punching a blank from the sheet and forming the blank partially into a completed shell, each of said first and second tooling sets further including upper first and second toolings, respectively, connected to said ram and cooperating lower first and second toolings, respectively, supported on said base;

third and fourth tooling sets, each of said third and fourth tooling sets receiving a shell from one of said first and second tooling sets and further being configured for forming the shell into a completed shell, each of said third and fourth tooling sets further including upper third and fourth toolings, respectively, connected to said ram and cooperating lower third and fourth toolings, respectively, supported on said base;

a lower transfer plate supported in fixed relation to said base at a level above said feed level but beneath said ram;

first means for propelling shells from said first tooling set and directing the shells at a lower transfer level edgewise along said lower transfer plate to said fourth tooling set, said first propelling means being mounted adjacent to said first tooling set;

first means for capturing and locating a shell at said fourth tooling set, said first capturing and locating means being mounted adjacent to said fourth tooling set;

an upper transfer plate supported in fixed relation to said base at a level above said lower transfer level but beneath said ram;

second means for propelling shells from said second tooling set and directing the shells at an upper transfer level edgewise along said upper transfer plate to said third tooling set, said second propelling means being mounted adjacent to said second tooling set;

second means for capturing and locating a shell at said third tooling set, said second capturing and locating means being mounted adjacent to said third tooling set;

first means for ejecting shells from said fourth tooling set and directing the shells edgewise from the apparatus, said first ejecting means being mounted adjacent to said fourth tooling set;

second means for ejecting shells from said third tooling set and directing the shells edgewise from the apparatus, said second ejecting means being mounted adjacent to said third tooling set;

means for selectively raising said ram above said upstroke position;

means for selectively raising said upper transfer plate from said lower support plate to provide, in conjunction with raising of said ram above said upstroke position, access to said lower transfer level;

means for selectively raising together said lower and said upper transfer plates from said base to provide, in conjunction with raising of said ram above said upstroke position, access to said feed level and said stock support plate; and means for selectively raising together said lower transfer plate, said upper transfer plate and said stock support plate to provide, in conjunction with raising of said ram above said upstroke position, access to said lower toolings.

2. Apparatus as defined in claim 1, wherein said means for supporting said ram includes a crown portion mounted in fixed relation over said base and a plurality of cylinder members extending downwardly from said crown to suspend said ram above said base.

3. Apparatus as defined in claim 2, wherein said means for raising said ram above said upstroke position includes a plurality of cylinder portions located within said ram and pistons located at the end of said cylinder members and engaged within said cylinder portions of said ram whereby relative movement of said pistons and said cylinder portion causes said ram to be raised.

4. Apparatus as defined in claim 2, further including a plurality of knock-out bars located between said ram and said upper toolings, said knock-out bars carrying a plurality of downwardly extending knock-out stems for cooperating with an upper portion of said upper toolings and having a stationary operative lower position located below said downstroke position of said ram.

5. Apparatus as defined in claim 4, wherein means are provided for raising said knock-out bars as said ram is raised above said upstroke position.

6. Apparatus as defined in claim 5, wherein said means for raising said knock-out bars includes a plurality of extendable cylinders carried by said press having one end thereof fixed relative to said crown portion, actuation of said extendable cylinders in a first direction causing said knock-out bars to assume their operative lower position and actuation of said extendable cylinders in a second direction causing said knock-out bars to move upwardly away from said upper tooling.

7. Apparatus as defined in claim 1, wherein said means for raising said upper transfer plate includes a plurality of first extendable cylinders carried by said press having one end thereof in fixed relation to said base and another end thereof connected to said upper transfer plate, actuation of said first cylinders causing said upper plate to be lifted from said lower transfer plate.

8. Apparatus as defined in claim 7 wherein said means for raising said lower and said upper transfer plates together includes a plurality of second extendable cylinders carried by said press having one end thereof in fixed relation to said base and another end thereof connected to said lower transfer plate, actuation of said first and second cylinders together causing said lower and upper plates to be lifted together from said base.

9. Apparatus as defined in claim 7, wherein said means for raising said lower and upper transfer plates and said stock support plate together includes means fastening said stock support plate to said lower transfer plate and a plurality of second extendable cylinders carried by said press having one end thereof in fixed relation to said base and another end thereof connected to said lower transfer plate, actuation of said first and second cylinders together causing said lower and upper transfer plates and said stock support plate to be lifted together from said base.

10. Apparatus for forming a plurality of shells such as used in the manufacture of can ends, comprising:

a base;

a ram;

means for supporting said ram at a distance above said base;

means for reciprocating said ram toward and away from said base between an upstroke and a downstroke position, respectively;

means for feeding a sheet of stock material at a feed level along said base;

first and second tooling sets, each of said first and second tooling sets being configured for punching a blank from the sheet and forming the blank partially into a completed shell, each of said first and second tooling sets further including upper first and second toolings, respectively, connected to said ram and cooperating lower first and second toolings, respectively, supported on said base;

third and fourth tooling sets, each of said third and fourth tooling sets receiving a shell from one of said first and second tooling sets and further being configured for forming the shell into a completed shell, each of said third and fourth tooling sets further including upper third and fourth toolings, respectively, connected to said ram and cooperating lower third and fourth toolings, respectively, supported on said base;

a lower transfer plate supported in fixed relation to said base at a level above said feed level but beneath said ram;

first means for guiding shells from said first tooling set at a lower transfer level edgewise along an upper surface of said lower transfer plate to said fourth tooling set;

first means for capturing and locating a shell at said fourth tooling set, said first capturing and locating means being mounted adjacent to said fourth tooling set;

an upper transfer plate supported in fixed relation to said base at a level above said lower transfer level but beneath said ram;

second means for guiding shells from said second tooling set at an upper transfer level edgewise along an upper surface of said upper transfer plate to said third tooling set;

second means for capturing and locating a shell at said third tooling set, said second capturing and locating means being mounted adjacent to said third tooling set;

means for selectively raising said ram above said upstroke position; and means for selectively raising said upper transfer plate from said lower transfer plate to provide, in conjunction with raising of said ram above said upstroke position, access to said lower transfer level.

11. Apparatus as defined in claim 10, further including means for selectively raising together said lower and upper transfer plates from said base to provide, in conjunction with raising of said ram above said upstroke position, access to said feed level.

12. Apparatus as defined in claim 11, wherein said means for raising said upper transfer plate includes a plurality of first extendable cylinders carried by said press having one end thereof in fixed relation to said base and another end thereof connected to said upper transfer plate, actuation of said first cylinders causing said upper pate to be lifted from said lower transfer plate.

13. Apparatus as defined in claim 12, wherein said means for raising said lower and said upper transfer plates together includes a plurality of second extendable cylinders carried by said press having one end thereof in fixed relation to said base and another end thereof connected to said lower transfer plate, actuation of said first and second cylinders together causing said lower and upper plates to be lifted together from said base.

14. Apparatus as defined in claim 10 wherein said means for supporting said ram includes a crown portion mounted in fixed relation over said base and a plurality of cylinder members extending downwardly from said crown to suspend said ram above said base.

15. Apparatus as defined in claim 14, further including a plurality of knock-out bars located between said ram and said upper toolings, said knock-out bars carrying a plurality of downwardly extending knock-out stems for cooperating with an upper portion of said upper toolings and having a stationary operative lower position located below said downstroke position of said ram.

16. Apparatus as defined in claim 15, wherein means are provided for raising said knock-out bars as said ram is raised above said upstroke position.

17. Apparatus as defined in claim 16, wherein said means for raising said knock-out bars includes a plurality of extendable cylinders carried by said press having one end thereof fixed relative to said crown portion, actuation of said extendable cylinders in a first direction causing said knock-out bars to assume their operative lower position and actuation of said extendable cylinders in a second direction causing said knock-out bars to move upwardly away from said upper tooling.

18. Apparatus for forming a plurality of shells such as used in the manufacture of can ends, comprising:

a base;

a ram;

a crown portion connected to said ram for supporting said ram at a distance above said base;

means for reciprocating said ram toward and away from said base between an upstroke and a downstroke position, respectively;

means for feeding a sheet of stock material at a feed level along said base;

a first station for forming shell preforms including upper tooling connected to said ram and cooperating lower tooling supported on said base;

a second station for completing shell formation including upper tooling connected to said ram and cooperating lower tooling supported on said base;

knock-out bars located below said ram and above said first and second station upper toolings, said knock-out bars carrying downwardly extending knock-out stems for cooperating with an upper portion of said upper toolings when said ram is in said upstroke position and said knock-out bars having a stationary operative lower position located below said downstroke position of said ram;

at least one transfer plate mounted in fixed relation to and extending across said press base and having means for guiding said shell preforms from said first to said second station;

means for selectively raising said ram above said upstroke position;

means for selectively raising said knock-out bars above said operative lower position; and means for selectively raising said at least one transfer plate away from said base to provide, in conjunction with raising of said ram and said knock-out bars above said upstroke position and said operative lower position, respectively, access to portions of said press under said at least one plate.

19. Apparatus as defined in claim 18 wherein said means for raising said knock-out bars includes a plurality of expendable cylinders carried by said press having one end thereof fixed relative to said crown portion, actuation of said extendable cylinders in a first direction causing said knock-out bars to assume their operative lower position and actuation of said extendable cylinders in a second direction causing said knock-out bars to move upwardly away from said upper tooling.

20. Apparatus as defined in claim 18, wherein said first station includes first and second rows of upper and lower tooling sets and said second station includes third and fourth rows of upper and lower tooling sets, and wherein a lower transfer plate is provided supported in fixed relation to said base at a level above said feed level and an upper transfer plate is provided supported in fixed relation to said base at a level above said lower transfer level.

21. Apparatus as defined in claim 20, further including means for selectively raising said upper transfer plate from said lower transfer plate to provide, in conjunction with raising of said ram above said upstroke position, access to said lower transfer level, and means for selectively raising together said lower and said upper transfer plates from said base to provide, in conjunction with raising of said ram above said upstroke position, access to said feed level.

22. Apparatus for forming a plurality of shells such as used in the manufacture of can ends, comprising:

a base;

a ram;

means for supporting said ram at a distance above said base;

means for reciprocating said ram toward and away from said base between an upstroke and a downstroke position, respectively;

first station tooling configured for punching a blank from sheet metal and forming the blank into a shell preform, said first station tooling including upper and lower toolings, respectively, connected to said ram and supported on said base;

second station tooling for receiving shell preforms from said first station tooling and being configured for forming the shell preform into a completed shell, said second station tooling further including upper and lower toolings, respectively, connected to said ram and supported on said base;

a lower transfer plate supported in fixed relation to said base at a level above said lower toolings;

first means for guiding shell preforms from said first tooling station at a lower transfer level edgewise along an upper surface of said lower transfer plate to said second tooling station;

first means for capturing and locating shell preforms in said second tooling station;

an upper transfer plate supported in fixed relation to said base at a level above said lower transfer level but beneath said ram;

second means for guiding other shell preforms from said first tooling station at an upper transfer level edgewise along an upper surface of said upper transfer plate to said second tooling station;

second means for capturing and locating the other shell preforms at said second tooling station;

means for selectively raising said ram above said upstroke position; and means for selectively raising said upper transfer plate from said lower transfer plate to provide, in conjunction with raising of said ram above said upstroke position, access to said lower transfer level.

23. Apparatus as defined in claim 22, further including means for selectively raising together said lower and upper transfer plates from said base.

24. Apparatus as defined in claim 23, wherein said means for raising said upper transfer plate includes a plurality of first extendable cylinders carried by said press having one end thereof in fixed relation to said base and another end thereof connected to said upper transfer plate, actuation of said first cylinders causing said upper plate to be lifted from said lower transfer plate.

25. Apparatus as defined in claim 24, wherein said means for raising said lower and said upper transfer plates together includes a plurality of second extendable cylinders carried by said press having one end thereof in fixed relation to said base and another end thereof connected to said lower transfer plate, actuation of said first and second cylinders together causing said lower and upper plates to be lifted together from said base.

26. A method for providing access to tooling elements for the production of shells, as for can ends, in a ram press, having a base and a ram supported for movement between an upstroke and a downstroke position above said base, comprising:

supporting cooperating upper and lower tooling on the press ram and the press base respectively and dividing the tooling into first and second tooling stations;

supporting knock-out bars at a stationary operative lower position below a lower surface of said ram and above said first and second station upper toolings wherein said knock-out bars carry downwardly extending knock-out stems for cooperating with an upper portion of said upper toolings when said ram is in said upstroke position;

supporting a lower transfer plate above said press base and below said ram;

supporting an upper transfer plate above said lower transfer plate and below said ram;

moving said ram to said upstroke position;

moving said knock-out bars upwardly away from said base to a point closely adjacent to the lower surface of said ram; and raising said ram and said knock-out bars together above said upstroke position of said ram.

27. A method as defined in claim 26, further comprising the steps of:

subsequent to moving said ram and said knock-out bars above said ram upstroke position, moving said upper transfer plate upwardly away from said lower transfer plate.

28. A method as defined in claim 26, further comprising the step of:

subsequent to moving said ram and said knock-out bars above said ram upstroke position, moving said upper and lower transfer plates together upwardly away from said base.

29. A method as defined in claim 26, further comprising the steps of:

supporting a stock feed pate on said base below said lower transfer plate, and subsequent to moving said ram and said knock-out bars above said ram upstroke position, moving said upper and lower transfer plates and said stock support pate together above said base to provide access to said lower tooling.

* * * * *